US008656890B2

(12) United States Patent
Farah et al.

(10) Patent No.: US 8,656,890 B2
(45) Date of Patent: Feb. 25, 2014

(54) SYSTEM AND METHOD FOR CONTROLLING AN INJECTION TIME OF A FUEL INJECTOR BASED ON CLOSING ELECTRICAL DECAY

(75) Inventors: Philippe S. Farah, Maisons-Laffitte (FR); Ronald J. Krefta, Noblesville, IN (US); Brent J. Wahba, Victor, NY (US); Eugene A. Kobos, Henrietta, NY (US); Kevin R. Keegan, Hilton, NY (US)

(73) Assignee: Delphi Technologies, Inc., Troy, MI (US)

( * ) Notice: Subject to any disclaimer, the term of this patent is extended or adjusted under 35 U.S.C. 154(b) by 525 days.

(21) Appl. No.: 13/069,862

(22) Filed: Mar. 23, 2011

(65) Prior Publication Data

US 2011/0251777 A1 Oct. 13, 2011

Related U.S. Application Data

(60) Provisional application No. 61/321,988, filed on Apr. 8, 2010.

(51) Int. Cl.
*F02M 1/00* (2006.01)

(52) U.S. Cl.
USPC ..... 123/445; 123/478; 123/480

(58) Field of Classification Search
USPC ..... 123/434, 445, 446, 472, 478, 480; 701/103–105
See application file for complete search history.

(56) References Cited

U.S. PATENT DOCUMENTS

| | | | | |
|---|---|---|---|---|
| 4,255,789 | A * | 3/1981 | Hartford et al. | 701/108 |
| 4,576,135 | A * | 3/1986 | Johnson | 123/490 |
| 5,954,030 | A * | 9/1999 | Sturman et al. | 123/446 |
| 2012/0191323 | A1 * | 7/2012 | Warner et al. | 701/104 |

* cited by examiner

*Primary Examiner* — John Kwon
(74) *Attorney, Agent, or Firm* — Lawrence D. Hazelton

(57) ABSTRACT

A system and method for controlling an injection time of a fuel injector. The system includes a drive circuit configured to output a drive signal having a pulse width, wherein the injection time is influenced by the pulse width and a closing electrical decay of the fuel injector. A controller is configured to determine the closing electrical decay of the fuel injector and adapt the pulse width based on the closing electrical decay to control the injection time. The closing electrical decay includes a closing response. The controller determines the closing response based on an injector signal, such as a coil voltage of the fuel injector. By determining the closing response, the pulse width can be adjusted to compensate for fuel injector part-to-part variability, fuel injector wear, variations in fuel pressure received by the fuel injector, dirt in the fuel injector, and the like.

11 Claims, 4 Drawing Sheets

SYSTEM AND METHOD FOR CONTROLLING AN INJECTION TIME OF A FUEL INJECTOR BASED ON CLOSING ELECTRICAL DECAY

CROSS-REFERENCE TO RELATED APPLICATION

This application claims the benefit under 35 U.S.C. § 119 (e) of U.S. Provisional Patent Application No. 61/321,988, filed Apr. 8, 2010, the entire disclosure of which is hereby incorporated herein by reference.

TECHNICAL FIELD OF INVENTION

The present invention relates generally to controlling fuel injectors of an internal combustion engine. In particular, the present invention relates to a fuel injector control system and method for determining a closing electrical decay of a fuel injector by monitoring an injector signal.

BACKGROUND OF INVENTION

Internal combustion engine designs must cope with the increasingly stringent regulations on pollutant emission and fuel economy. One way to reduce emissions and increase fuel economy is to accurately control the combustion air/fuel ratio. This is generally accomplished by more precisely controlling the amount of fuel injected into an engine. U.S. Pat. No. 6,382,198 describes a direct injection engine with an enhanced fuel control system using a single oxygen sensor as combustion performance indicator. The Engine Control Module (ECM) of this system is capable of determining the actual air/fuel ratio corresponding to each individual cylinder. Such an ECM may be known as an Individual Cylinder Fuel Control (ICFC) module and is configured to develop individual correction factors for each individual fuel injector. However, it has been observed that many fuel injectors do not have fully predictable flow performances, which leads to performance deviation or variability between injectors of a same design. Variability between injectors is generally linked to production process variation and/or to the time-drift variations due to aging. Thus, individual fuel injector flow variations need to be corrected.

SUMMARY OF THE INVENTION

In accordance with one embodiment of this invention, a system for controlling an injection time of a fuel injector is provided. The said system includes a drive circuit and a controller. The drive circuit is configured to output a drive signal characterized as having a pulse width, wherein the injection time is influenced by the pulse width and a closing electrical decay of the fuel injector. The controller is configured to determine the closing electrical decay of the fuel injector and adapt the pulse width based on the closing electrical decay to control the injection time.

In another embodiment of the present invention, the closing electrical decay is characterized as having a closing response, and the controller determines the closing response based on an injector signal.

In yet another embodiment of the present invention, a method for controlling an injection time of a fuel injector provided. The method includes the step of outputting a drive signal characterized as having a pulse width, wherein the injection time is influenced by the pulse width and a closing electrical decay of the fuel injector. The method also includes the step of determining the closing electrical decay of the fuel injector. The method also includes the step of adapting the pulse width based on the closing electrical decay to control the injection time.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION OF INVENTION

Figure 1:
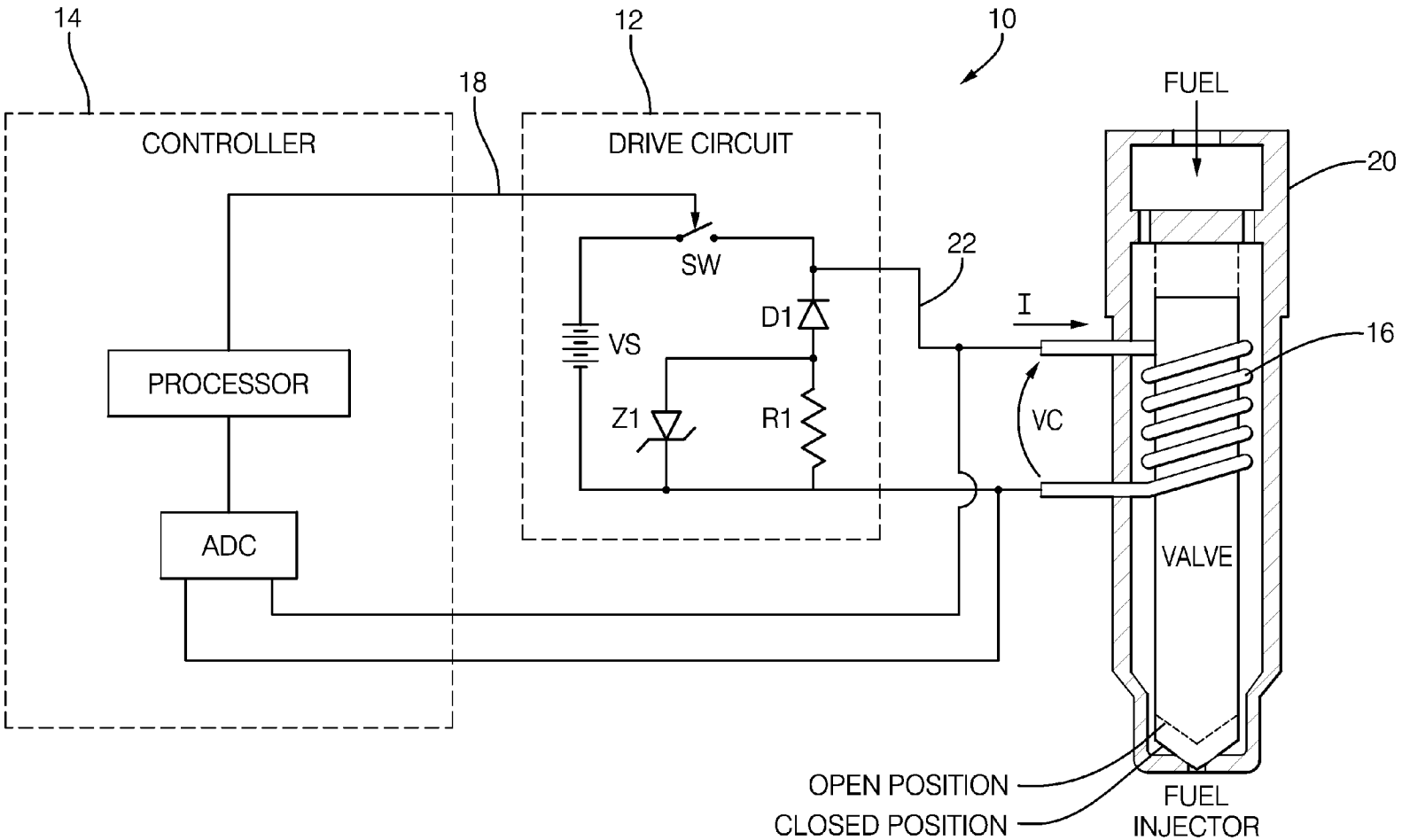
FIG. 1 is a schematic diagram of a system for controlling an injection time of a fuel injector in accordance with one embodiment.

In accordance with an embodiment of a system for controlling an injection time of a fuel injector, FIG. 1 illustrates a system 10 that includes a drive circuit 12 and a controller 14 electrically coupled to a fuel injector 20. In this non-limiting example, the fuel injector 20 illustrated is an electromagnetic type that operates a valve or pintle between an open position and a closed position. The open position allows fuel to be dispensed by the fuel injector 20, and the closed position blocks fuel from being dispensed by the fuel injector 20. In this example, the position of the valve is generally dependent on the amount of electrical current I passing through a coil 16 in the fuel injector 20. Alternatively, the fuel injector 20 may be a piezoelectric type fuel injector that controls the position of the valve based on the amount of electrical voltage present across a piezoelectric element in the fuel injector 20. While only one fuel injector is illustrated, the teachings herein can be applied to systems having multiple fuel injectors.

FIG. 1 further illustrates a non-limiting example of a drive circuit 12 suitable for operating the fuel injector 20. The drive circuit 12 may include a voltage source VS to provide a suitable voltage potential to operate the fuel injector 20, for example 14 Volts. The voltage source VS may be a battery as suggested in the illustration. The battery may be rechargeable, such as a lead acid battery, and the battery may be connected to a vehicle electrical system (not shown) that is configured to recharge the battery. The drive circuit may also include a switch SW operable to an open state as illustrated, and to a closed state whereby the voltage source VS is connected to the fuel injector 20 such that a coil voltage VC has a voltage value approximately equal to the voltage value output by the voltage source VS. The switch SW is preferably a solid state device such as a transistor (e.g.—MOSFET, IGBT), but could be a relay or like. The switch SW may be operated by a control signal 18 from the controller 14. The control signal 18 may be a steady signal that holds the switch SW in the closed state for a period of time to influence a desired injection time of the fuel injector 20, or may be a pulse-width-modulated (PWM) signal having a variable duty cycle and the PWM signal lasts for a period of time to influence the desired injection time.

Figure 2:
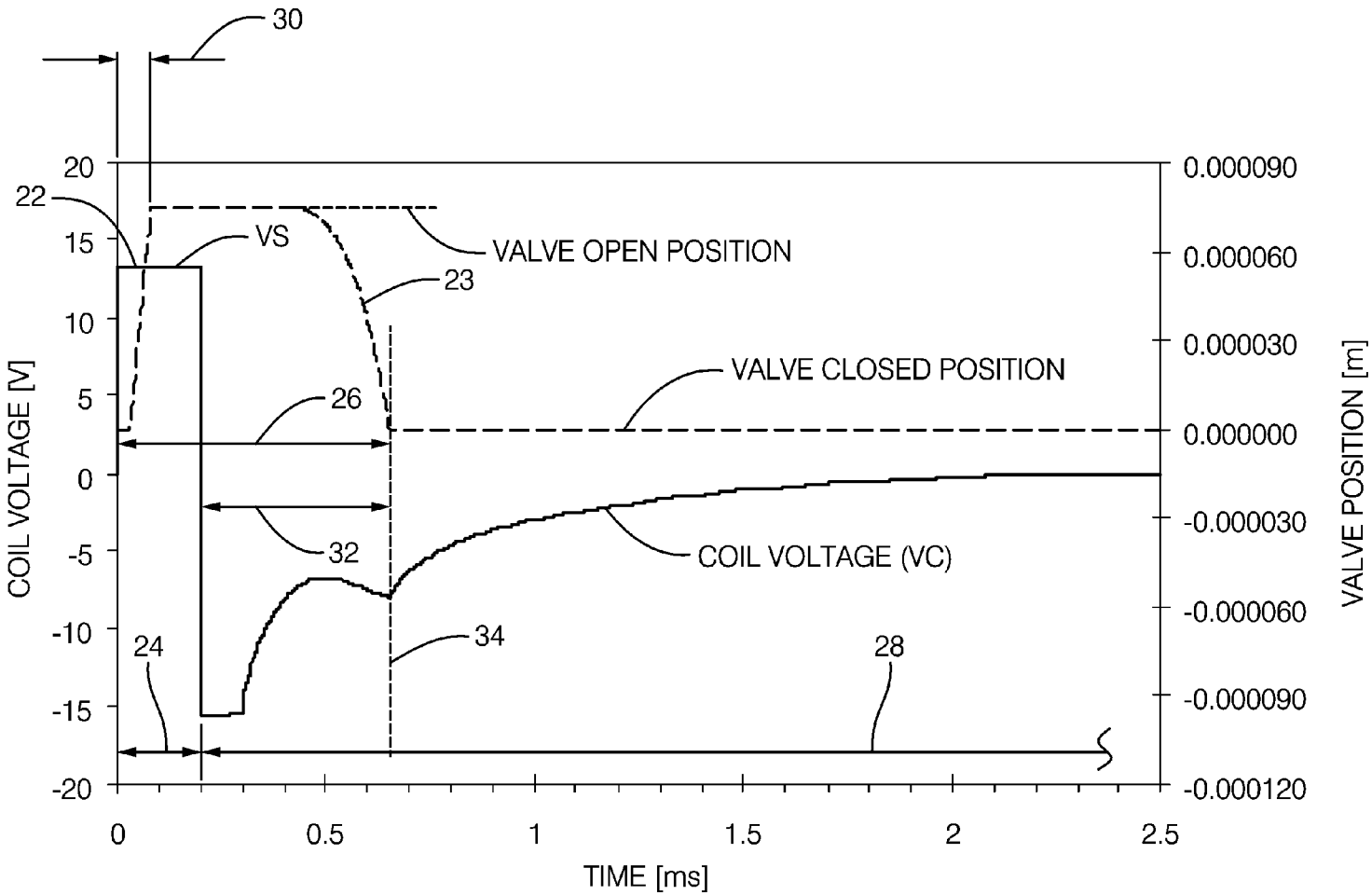
FIG. 2 is a graph of signals occurring in of FIG. 1 in accordance with one embodiment.

FIG. 2 illustrates a non-limiting graphical depiction of a drive signal 22 output by the drive circuit 12 suitable to be applied to the coil 16 of the fuel injector 20 and thereby influence the value of the coil voltage VC. The drive signal 22 may be characterized as having a pulse width 24 corresponding to the time that the switch SW is in the closed state. In general, the amount of fuel dispensed by the fuel injector 20 may be controlled by varying the duration of the pulse width 24. For the example schematic shown in FIG. 1, while the switch SW is in the closed state it follows that the value of the drive signal 22 and the value of the coil voltage VC generally corresponds to the voltage value output by the voltage source VS. However, when the switch SW is in the open state, the value of the drive signal 22 and the value of the coil voltage VC are generally determined by the electrical current I and electrical components within the drive circuit 12, for example Zener diode Z1, blocking diode D1, and resistor R1.

The electrical network illustrated for the drive circuit 12 is for the purpose of explanation and not limitation. For example, if the control signal 18 was a pulse width modulated (PWM) type signal, instead of a constant signal as suggested by the illustration of the drive signal 22 during the pulse width 24, then the network of electrical components forming the drive circuit 12 would likely be more complicated and may include additional switches and/or other electrical components. While not subscribing to any particular theory, and for the non-limiting network illustrated, at the moment following the switch SW operating from the closed state to the open state, a negative coil voltage may be induced as illustrated. It is believed that the negative coil voltage VC is initially limited by the breakdown voltage of the Zener diode Z1, and then as the electrical current I decays toward zero, the coil voltage VC may be influenced by the amount of current flowing through resistor R1 and the forward voltage of the blocking diode D1, and/or rate change of injector flux, as supported by eddy currents flowing through the injector steel. Those skilled in the art will recognize that the electrical component values are selected based on electrical characteristics of the fuel injector 20, the voltage source VS, and other considerations beyond the scope of this description.

FIG. 2 also illustrates a non-limiting, graphical depiction of pintle movement or valve position 23 within the fuel injector 20 in response to the drive signal 22. The fuel injector 20 typically has mechanical stops (not show) that limit the valve position to motion between the valve open position and the valve closed position. FIG. 2 also illustrates an injection time 26 that generally begins when the pulse width 24 begins and ends when the valve position 23 first reaches the valve closed position. The injection is influenced by the pulse width 24 and a closing electrical decay 28. The closing electrical decay 28 starts when the switch SW opens and generally ends when the electrical current I decays to near zero, or the coil voltage VC returns to near zero, or the valve reaches its closed position. As used herein, the closing electrical decay 28 includes any feature or characteristic of the coil voltage VC that could be used to determine some operating condition or characteristic of the fuel injector 20.

FIG. 2 further illustrates that the injection time 26 encompasses part of an opening time 30. The opening time 30 starts when the switch SW closes and ends when the valve position first reaches the valve open position. The opening time 30 is needed to estimate how much fuel is dispense by the fuel injector 20 in response to the pulse width 24 since the fuel injector 20 does not immediately begin to provide full fuel flow from the fuel injector 20 at the beginning of the pulse width 24.

FIG. 2 also illustrates that the valve position 23 may remain in the open position after the end of the pulse width 24 because of excessive coil current I. However, there are known techniques such as pulse width modulating the drive signal 22 that may be used to limit the coil current I to a value that is just sufficient to hold the valve of the fuel injector 20 in the open position. Limiting the coil current I may minimize the amount of time that the valve hangs in the open position after the end of the pulse width 24 and before beginning to transition to the closed position. As such, the closing electrical decay 28 may be characterized as having a closing response 32 that includes this hang time plus the time it takes the valve to transition from the open position to the closed position. The point in time that valve reaches the closed position is designated as a contact time 34.

A suitable formula for indicating the amount of fuel delivered by the fuel injector 20 in response to the drive signal 22 may be $$\text{Fuel Amount}=k1*(\text{Pulse Width}-k2*\text{Opening Time}+k3*\text{Closing Response}) \quad (1)$$

While not subscribing to any particular theory, it is believed that while the injector is opening or closing, that is in transition between the valve open position and the valve closed position, the fuel flow rate is less than when it is fully open, and so values for constants k2 and k3 are selected to compensate for that effect. These constants are typically determined through tests. It will be appreciated that longer closing electrical decay 28 or longer closing response 32 will result in a proportionately greater amount of fuel being dispensed by the fuel injector 20. For the purposes of explanation and not limitation, the constants can be considered as representing an average pintle stroke or average valve position between the open position and the closed position that is constant over the opening time 30 and closing response 32, respectively and so would generally have values between zero (0) and one (1).

It has been observed during testing that the opening time 30 appears to be fairly constant and so Eq. 1 term [k2*Opening Time]can typically be a fixed value. However, it has also been observed that there may be substantial variation in the closing electrical decay 28 and so the closing response 32 for Eq. 1 term [k3*Closing Response] needs to be determined to accurately control the Fuel Amount according to Eq. 1. Thus, if the closing response 32 is determined, the pulse width 24 can be adjusted to adapt the pulse width 24 based on the closing electrical decay 28 to control the injection time 26 and thereby control the amount of fuel dispensed by the fuel injector 20.

Referring again to FIG. 1, the controller 14 may be configured to determine the closing electrical decay 28 of the fuel injector 20 and may be configured to adapt the pulse width 24 based on the closing electrical decay 28 to control the injection time 26. The controller 14 may include a processor such as a microprocessor or other control circuitry as should be evident to those in the art. The controller 14 may include memory, including non-volatile memory, such as electrically erasable programmable read-only memory (EEPROM) for storing one or more routines, thresholds and captured data. The one or more routines may be executed by the processor to perform steps for determining if signals received by the controller 14 for controlling injection time 26 as described herein. The controller 14 may also include a voltage measuring means such as an analog-to-digital converter (ADC) for converting voltages such as coil voltage VC in to a digital code suitable for use by the processor.

Figure 3:
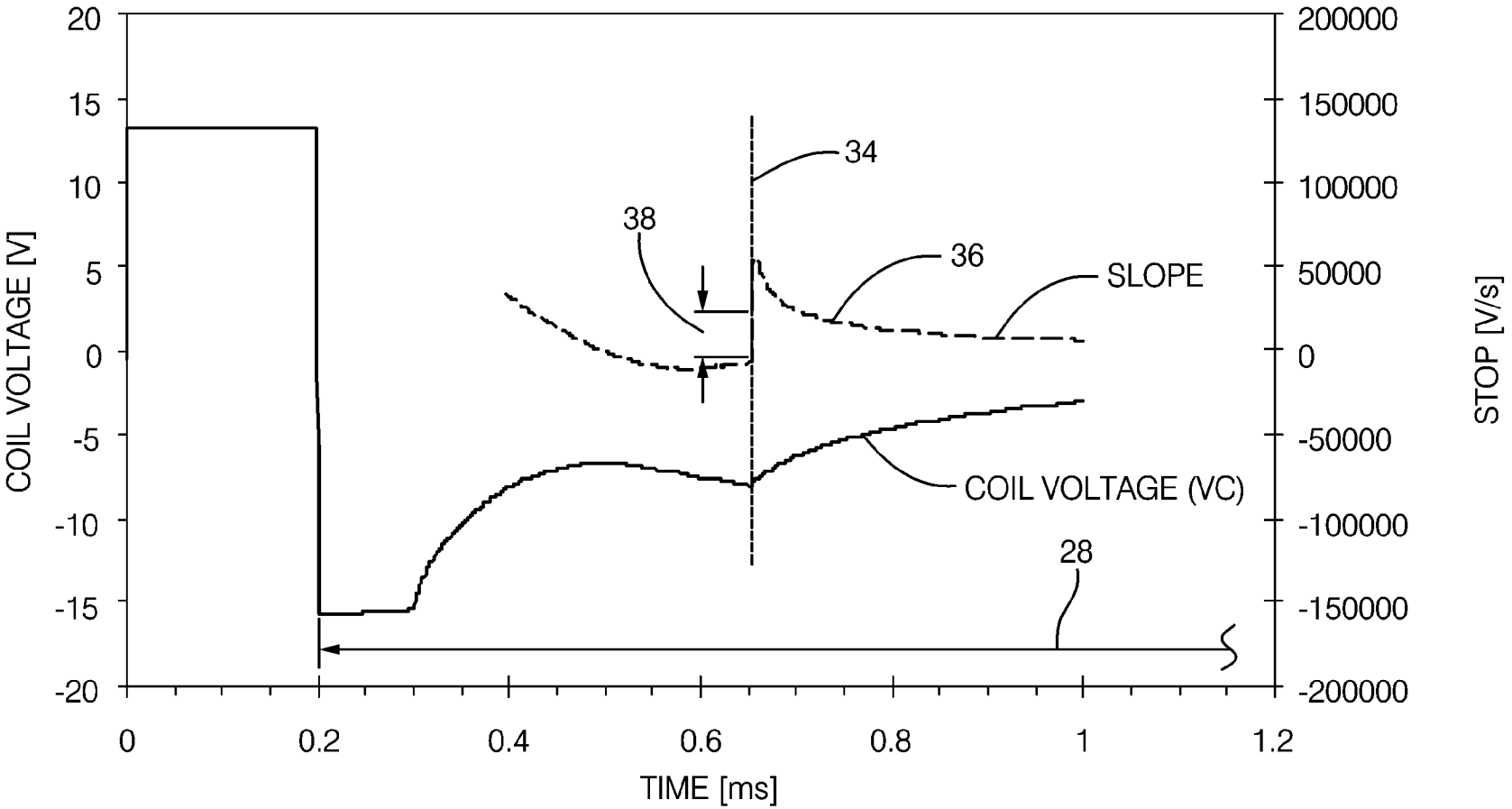
FIG. 3 is a graph of signals occurring in of FIG. 1 in accordance with one embodiment.

FIG. 3 is in part a close-up view of FIG. 2 illustrating the coil voltage VC during a closing electrical decay 28. FIG. 3 also illustrates a graphical depiction of a calculated slope of the coil voltage VC versus time (i.e.—dV/dt), hereafter slope 36. The slope 36 may be calculated by the controller 14 using any of a number of known signal processing techniques, for example by performing a regression analysis of a selected number of previous coil voltage values measured by the ADC. It has been discovered that the contact time 34 may be determined by monitoring the coil voltage VC, in particular the slope 36. Additionally, it has been discovered that variation in the closing electrical decay 28 is an indicator of variation in the injector electrical and/or mechanical response. Such information is useful during the development of injectors to assess part-to-part variation or to detect wear-out or eminent failure of the fuel injector 20.

While not subscribing to any particular theory, when the coil current I or injector flux decays to a value less than that necessary to hold the valve in the open position, the valve begins to move toward the closed position. As this happens, it is believed that the motion of the valve induces a voltage in opposition to that induced by the decay of the coil current I or injector flux, and so the value of the coil voltage VC begins to decrease (i.e.—become more negative). On FIG. 3 this is illustrated after about the 0.5 millisecond (ms) point of time line, and continues until the contact time 34 as illustrated. When the valve reaches the closed position at the contact time 34, there is a perturbation in the coil voltage VC that is readily detected as a sudden increase in the value of the slope 36. The perturbation in the coil voltage VC is believed to be linked to a change in the velocity term of the flux linkage I dL/dx dx/dt, where dx/dt is the velocity of the valve, which is greatly reduced when the valve reaches the valve closed position.

In view of the description above, system 10 for controlling an injection time 26 of a fuel injector 20 is described. In one embodiment, the system 10 may include a drive circuit 12 configured to output a drive signal 22 characterized as having a pulse width 24, wherein the injection time 26 is influenced by the pulse width 24 and a closing electrical decay 28 of the fuel injector 20. The system 10 may also include a controller 14 configured to determine the closing electrical decay 28 of the fuel injector 20 and adapt the pulse width 24 based on the closing electrical decay 28 to control the injection time 26. The closing electrical decay 28 may be characterized as having a closing response 32, and the controller 14 may be configured to determine the closing response 32 based on an injector signal. The description above describes one embodiment where the injector signal corresponds to the coil voltage VC. Using coil voltage VC is advantageous because the coil voltage VC occurs naturally as part of operating the fuel injector, and so does not increase system cost other than providing a voltage measuring means such as an ADC. Alternatively, the injector signal may be the coil current I, possible detected by a current sensor or other such device coupled to the controller 14. Another alternative is to equip the fuel injector 20 with an accelerometer or position sensor coupled to the pintle or valve, and outputting an injector signal from those added devices to determine the position of the valve and so determine the closing response 32. Adding an accelerometer or position sensor may be advantageous for certain injector designs that do not exhibit a coil voltage that has an easily detected contact time 34, or in electrical environments that have substantial amounts of interfering electrical noise.

As described above the slope 36 of the coil voltage VC may be useful for indicating the closing response 32 and so may be useful for determining contact time 34. The alternative injector signals (coil current, valve acceleration, and valve position) also have slope characteristics that may be used to indicate the closing response 32 and determine contact time 34. In particular, the closing response 32 or the contact time 34 may be determined by detecting a change in the slope value or slope characteristic that is greater than a slope threshold 38. The slope threshold 38 may be preselected and programmed into the controller 14 as part of the vehicle calibration process, or may be dynamically determined based on signal analysis of the injector signal. It will be appreciated that an optimum slope threshold may vary with changes in fuel injector design, drive circuit design, and drive signal parameters. As suggested in FIG. 3, a slope threshold of about 25,000 Volts/second may be a suitable value for the system 10.

Figure 4:
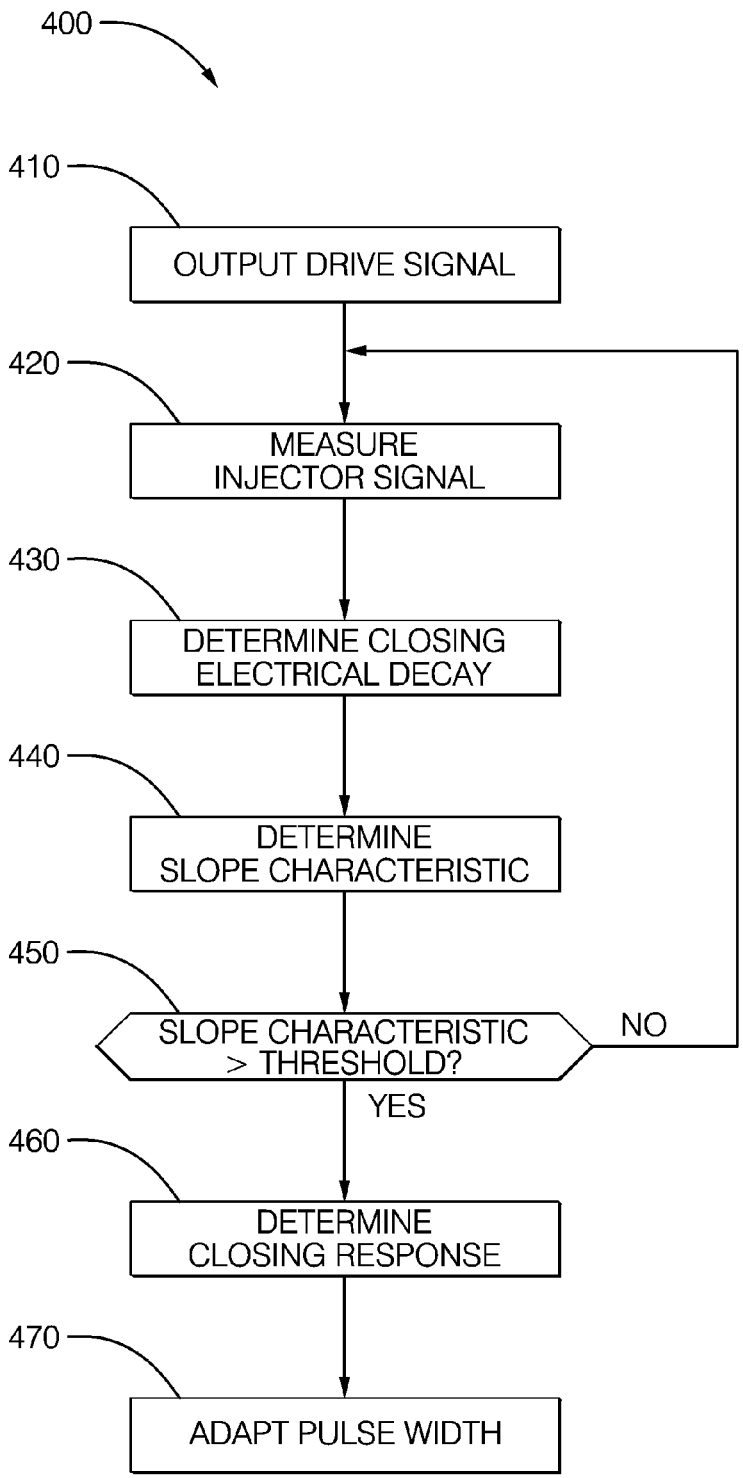
FIG. 4 is flow chart of a method performed by the system of FIG. 1 in accordance with one embodiment.

FIG. 4 illustrates a method 400 for controlling an injection time of a fuel injector. Step 410, OUTPUT DRIVE SIGNAL, may include a drive circuit 12 outputting a drive signal 22 characterized as having a pulse width 24, wherein the injection time 26 is influenced by the pulse width 24 and a closing electrical decay 28 of the fuel injector 20. Step 420, MEASURING INJECTOR SIGNAL, may include measuring a coil voltage VC of the fuel injector 20 by an ADC in the controller 14. Other alternatives to the coil voltage VC for measuring an injector signal are described above.

Step 430, DETERMINE CLOSING ELECTRICAL DECAY, may include determining the closing electrical decay 28 of the fuel injector 20. This may be performed by the controller 14 either processing the injector signal measurements from step 420 as they are received, or this step may be executed after injector signal measurements are accumulated for a period of time selected to be long enough to encompass the contact time 34.

Step 440, DETERMINE SLOPE CHARACTERISTIC, may include determining a slope characteristic of the injector signal, for example by determining the slope 36 of the coil voltage VC. Determining the slope 36 may include filtering the coil voltage VC data, and/or calculating the slope 36 using regression analysis or other known algorithms for calculating slope. Determining the slope 34 may include ignoring injector signal data for a predetermined period of time so as to avoid calculating slopes at time well before the contact time is expected. FIG. 3 illustrates this as the slope calculation starting at a time about 0.2 ms following the opening of the switch SW, for example at time 0.4 ms on FIG. 3.

Step 450, SLOPE CHARACTERISTIC >THRESHOLD? , may include determining that the slope characteristic has a slope value that has changed or increased by an amount greater than the slope threshold 38, for example the slope value has increased by more than 25,000 Volts/second. By determining when the slope threshold 38 is exceeded, the contact time 34 can be determined.

Step 460, DETERMINE CLOSING RESPONSE, may include determining a closing response 32 based on an injector signal, for example by calculating the time difference between time that the switch SW opens and the contact time 34.

Step 470, ADAPT PULSE WIDTH, may include adapting the pulse width 24 based on the closing electrical decay 28 to control the injection time 26. For example, adapting the pulse width may include using the closing response 32 to adjust the next pulse width so that the fuel amount delivered according to Eq. 1 is comparable to the desired fuel amount. Adapting the pulse width 24 may also include adjusting the pulse width 24 to compensate for readings from other vehicle engine sensors such as an oxygen sensor in the exhaust stream, an EGR valve position, an inlet throttle position, etcetera.

Accordingly, a system 10, a controller 14 for the system 10 and a method 400 for controlling an injection time of a fuel injector is provided. By determining the closing response 32, the pulse width 24 can be adjusted to compensate for fuel injector part-to-part variability, fuel injector wear, variations in fuel pressure received by the fuel injector 20, dirt in the fuel injector 20, and the like.

While this invention has been described in terms of the preferred embodiments thereof, it is not intended to be so limited, but rather only to the extent set forth in the claims that follow.

We claim:

1. A system for controlling an injection time of a fuel injector, said system comprising:

a drive circuit configured to output a drive signal characterized as having a pulse width, wherein the injection time is influenced by the pulse width and a closing electrical decay of the fuel injector; and a controller configured to determine the closing electrical decay of the fuel injector and adapt the pulse width based on the closing electrical decay to control the injection time.

2. The system in accordance with claim 1, wherein the closing electrical decay is characterized as having a closing response, and the controller determines the closing response based on an injector signal.

3. The system in accordance with claim 2, wherein the injector signal is characterized as having a slope characteristic indicative of the closing response.

4. The system in accordance with claim 3, wherein the closing response is indicated by a slope value change of the slope characteristic by an amount greater than a threshold.

5. The system in accordance with claim 2, wherein the system further comprises a voltage measuring means configured to measure the injector signal.

6. The system in accordance with claim 2, wherein the injector signal is based on a coil voltage of the fuel injector.

7. A method for controlling an injection time of a fuel injector, said method comprising the steps of:

outputting a drive signal characterized as having a pulse width, wherein the injection time is influenced by the pulse width and a closing electrical decay of the fuel injector;

determining the closing electrical decay of the fuel injector; and adapting the pulse width based on the closing electrical decay to control the injection time.

8. The method in accordance with claim 7, wherein the step of determining the closing electrical decay includes determining a closing response based on an injector signal.

9. The method in accordance with claim 8, wherein the step of determining a closing response includes determining a slope characteristic of the injector signal.

10. The method in accordance with claim 9, wherein the step of determining the closing response includes determining that the slope characteristic has a slope value that has changed by an amount greater than a threshold.

11. The method in accordance with claim 7, wherein the step of determining the closing electrical decay includes measuring a coil voltage of the fuel injector.

* * * * *